US005209674A

United States Patent [19]

Foster et al.

[11] Patent Number: 5,209,674

[45] Date of Patent: May 11, 1993

[54] END-TO-END NEON TUBE CONNECTOR

[76] Inventors: Ronald A. Foster, 1330 Deer Ridge, Duncanville, Tex. 75135; Ruben A. Reyes, 3527 Rio Grande Cir., Dallas, Tex. 75233

[21] Appl. No.: 831,007

[22] Filed: Feb. 6, 1992

Related U.S. Application Data

[63] Continuation-in-part of Ser. No. 788,148, Nov. 6, 1991, abandoned.

[51] Int. Cl.[5] ..... H01R 33/02

[52] U.S. Cl. ..... 439/235; 439/234; 439/242; 362/263

[58] Field of Search ..... 362/216, 217, 263; 439/226, 227, 228, 231, 232, 233, 234, 235, 242, 243

[56] References Cited

U.S. PATENT DOCUMENTS

| | | | |
|---|---|---|---|
| 1,817,543 | 8/1931 | Ciraolo | 362/217 |
| 2,311,829 | 2/1943 | Hart | 439/235 |
| 3,562,511 | 2/1971 | Reeves | 439/234 |
| 4,947,301 | 8/1990 | Steele | 362/263 X |
| 5,001,613 | 3/1991 | Foster et al. | 362/223 |
| 5,008,787 | 4/1991 | Sklar et al. | 362/263 X |

*Primary Examiner*—Larry I. Schwartz
*Assistant Examiner*—Khiem Nguyen
*Attorney, Agent, or Firm*—David H. Judson

[57] ABSTRACT

The invention describes a connector for a pair of neon tubes supported in an end-to-end manner, each of the tubes having a reversely bent end. The connector comprises a support base formed of insulating material and having a longitudinally-extending slot, an electrical connector supported in the base underlying the slot, and first and second electrode housings supported in opposed relation, each of the electrode housings slidably mounted on the base and including a contactor for being received in the slot when the electrode housing is located in a first position to thereby complete and electrical connection between the ends of the neon tubes.

14 Claims, 3 Drawing Sheets

END-TO-END NEON TUBE CONNECTOR

This is a continuation-in-part of prior copending application Ser. No. 07/788,148 filed on Nov. 6, 1991 now abandoned.

TECHNICAL FIELD

The present invention relates generally to the field of neon tube lighting and more specifically to a connector for providing a secure electrical and mechanical connection between the ends of adjoining neon tubes.

BACKGROUND OF THE INVENTION

Conventional neon tube lighting systems are well-known in the prior art. Such systems typically include a plurality of neon tubes. The end of each neon tube is normally bent back and encompasses an electrode connected by a wire to an electrically-conductive metal cap. The cap may have a wire protruding from its end face for connection to either an exciting transformer or to the cap of an adjacent tube when two tubes are aligned in an endwise fashion.

It is also known in the art to provide electrical connectors for neon tubes supported in an end-to-end fashion. Examples of such connectors are shown in U.S. Pat. Nos. 1,817,543, 2,175,155, 2,238,589 and 4,947,301. U.S. Pat. No. 2,238,589 to Hensler, for example, discloses one such connector having a pair of tubular sections each including a closed outer end and telescopically engaged inner ends axially interfitted one within the other. A spring like electrical connector element is used to connect the ends of adjacent tubes. A similar system is shown in U.S. Pat. No. 2,175,155 to Miller, which teaches a jumper connector comprising a pair of hook ends disposed in confronting relation. Each hook end has a tubular stem and the stems are adapted to interfit with respect to each other to form a telescoping structure. A coiled wire provides the electrical connection.

The above-described prior art connectors do not provide secure electrical and mechanical connection between endwise-supported neon tubes. These devices are also difficult to use without damaging the fragile neon tubes. Moreover, many of these electrical connectors, such as those shown in the Miller and Hensler patents, require supplemental support structures.

It would therefore be desirable to provide an improved end-to-end electrical connector for neon tubing that overcomes these and other problems associated with the prior art.

BRIEF SUMMARY OF THE INVENTION

It is an object of the present invention to provide an end-to-end electrical connector for a pair of neon tubes.

It is yet another object of the present invention to provide a novel connector assembly for use in a neon tube lighting system.

It is a still further object to provide an end-to-end connector for a neon tube lighting system that is easy to use and that minimizes the likelihood of damaging the fragile lighting elements during maintenance of the system.

These and other objects of the invention are provided by a connector assembly for a pair of neon tubes supported in an end-to-end manner, each of the tubes having a reversely bent end. The assembly comprises a support base formed of insulating material and having a longitudinally extending slot. An electrical conductor strip is embedded or otherwise supported in the support base underlying the slot such that the conductive strip is accessed through the slot. A pair of electrode housings are supported in opposed relation on the base. Each of the housings is slidably mounted on the base and includes a spring-biased contactor. Each housing includes an open inner end for receiving a reversely bent end of one of the neon tubes. To establish an electrical connection between the aligned neon tubes, each electrode housing is located in a first position with its contactor received in the slot and in contact with the conductive strip. When an electrode housing is reciprocated on the base to a predetermined second position, the contactor of the housing disengages from the strip and the electrical connection is broken. With the electrode housing in the second position, the neon tube can be repaired or replaced.

The foregoing has outlined some of the more pertinent objects of the present invention. These objects should be construed to be merely illustrative of some of the more prominent features and applications of the invention. Many other beneficial results can be attained by applying the disclosed invention in a different manner or modifying the invention as will be described. Accordingly, other objects and a fuller understanding of the invention may be had by referring to the following Detailed Description of the preferred embodiment.

BRIEF DESCRIPTION OF THE DRAWINGS

For a more complete understanding of the present invention and the advantages thereof, reference should be made to the following Detailed Description taken in connection with the accompanying drawings in which.

Similar reference characters refer to similar parts throughout the several views of the drawings.

DETAILED DESCRIPTION

Figure 1:
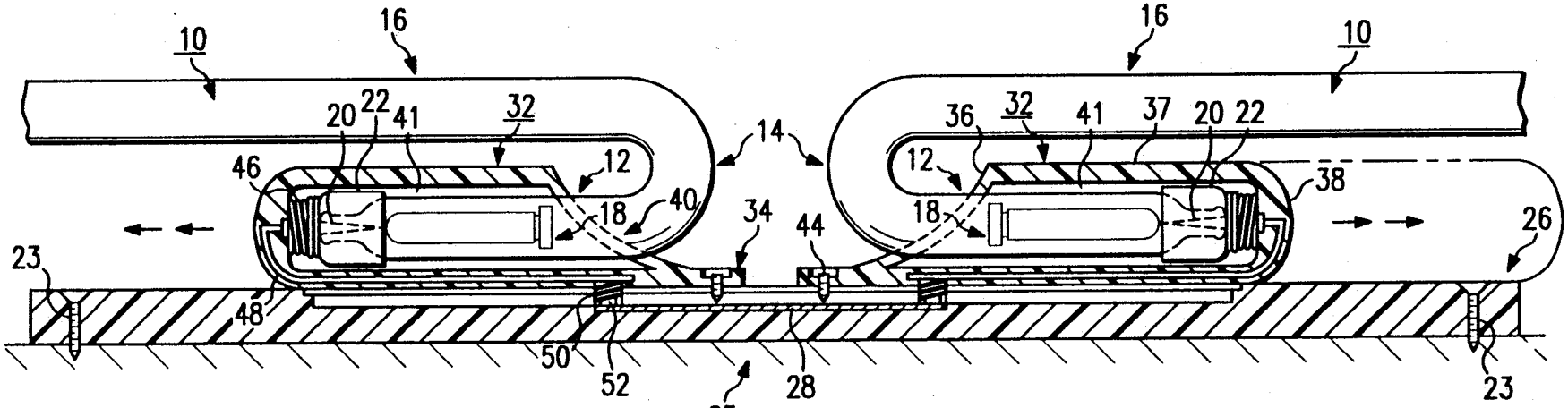
FIG. 1 is an elevational view of one embodiment of the end-to-end neon tube connector assembly of the present invention.
Figure 2:
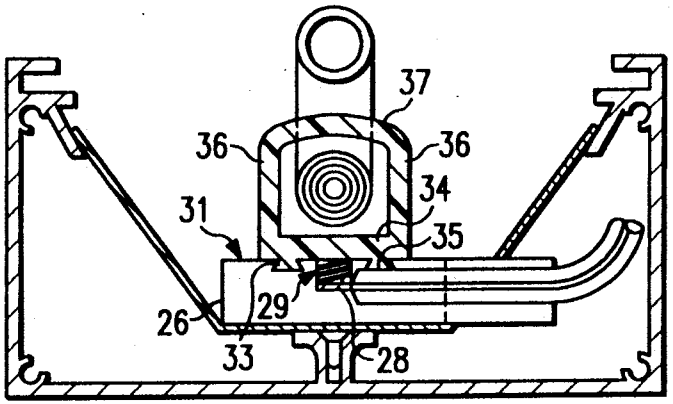
FIG. 2 is an end view of one of the electrode housings of FIG. 1.

Referring now to FIGS. 1–2, elevational and end views are shown of an end-to-end neon tube installation utilizing the connector assembly of the present invention. As seen in FIG. 1, each end 12 of the neon tube 10 is bent back at 14 and extends for a short distance parallel to the straight portion 16 of the tube. The reversely bent end 12 encompasses an electrode 18 connected by a wire 20 to an electrically conductive metal cap 22. According to the invention, an electrical connection is effected between the caps 22 of endwise-supported neon tubes 10 through an end-to-end connector designated generally by the reference numeral 25. Connector 25 comprises a support base 26 formed of a UL-approved non-combustible, non-absorbent insulating material A jumper connector 28 is embedded in the support base 26. A slot 29 (best seen in FIG. 2) overlies the jumper connector 28 throughout its longitudinal extent for the purposes to be described. Base 26 is designed to be rigidly secured to a wall or to a neon tube lighting system extrusion, such as shown in U.S. Pat. No. 5,001,613 to Foster et al, via screws 23 or other suitable fastening means.

The connector 25 includes first and second electrode housings 32 supported on the support base 26 in opposed or confronting relation. Referring to the end view of FIG. 2, each housing 32 includes one or more extensions 33 that are engaged in mating grooves 35 extending longitudinally along the top surface 31 of the base 26. Although two grooves 35 are shown, only one is required. Each housing 32 is thus slidably mounted in the base 26 and is adapted to reciprocate between a first closed position, such as shown in FIG. 1, to a second open position shown in phantom. In the second position, the end 12 of the tube can be raised (relative to the base 26) to enable the tube to be replaced or repaired without disconnecting or otherwise affecting any mechanical or electrical connection between the tubes. When the tube has been repaired (or when a new tube is installed), the tube is set on the base in the correct position and the electrode housing 32 is slide from the second position back to the first position, thereby making proper electrical contact with the adjoining neon tube.

Each electrode housing 32 is formed of the insulating material. Referring simultaneously to FIGS. 1 and 2, the housing comprises a base 34, a pair of sidewalls 36, and a top 37, and a closed outer end 38. The housing 32 has an inner end 40 opening into a chamber 41 extending axially through the housing. The chamber 41 receives the reversely bent end 12 of the neon tube. Each sidewall 36 preferably includes a sloped edge portion to form the inner end 40 of the housing. This structure serves to protect the fragile neon tubing as the housing is reciprocated between the first and second positions. A set screw 44 or other suitable fastener is used to secure the housing 32 to the base 26 of the connector assembly. Loosening of the set screw 44 enables the housing to be reciprocated between the first and second positions.

The electrical connection between the ends of the endwise-supported neon tubes is facilitated by the jumper connector 28. In particular, each electrode housing further includes a contact spring member 46 supported in the closed outer end 36. This spring member 46 is designed to overlay the metal cap 22 of the neon tube. An electrical wire 48 is embedded in the electrode housing and interconnects the contact spring member 46 and an spring member 50 that includes a contactor 52 that projects outwardly from the electrode housing and into the slot 29 of the base 26. Contactor 52 engages the jumper connector 28 when the electrode housing is located in the first position to complete the electrical circuit between the jumper connector and the metal cap 22 of the neon tube 10. When the electrode housing 32 is retracted to the open position, the contactor 52 extends beyond the longitudinal extent of the jumper connector 28, thus interrupting the electrical connection.

The end-to-end connector of the invention provides improved electrical and mechanical connection compared to prior art devices. Each of the electrode housings 32 is independently slidable between open and closed positions to enable access to each of the adjoining neon tubes. The electrode housings themselves are not attached to each other, but rather reciprocate on a fixed support base in which the electrical jumper connector is supported. The only wires used in the connector are embedded in the housing, thus providing much greater reliability. The connector is simple to use and significantly reduces the likelihood of damage to the neon tubing during repair or replacement of the lighting elements of the system.

Figure 3:
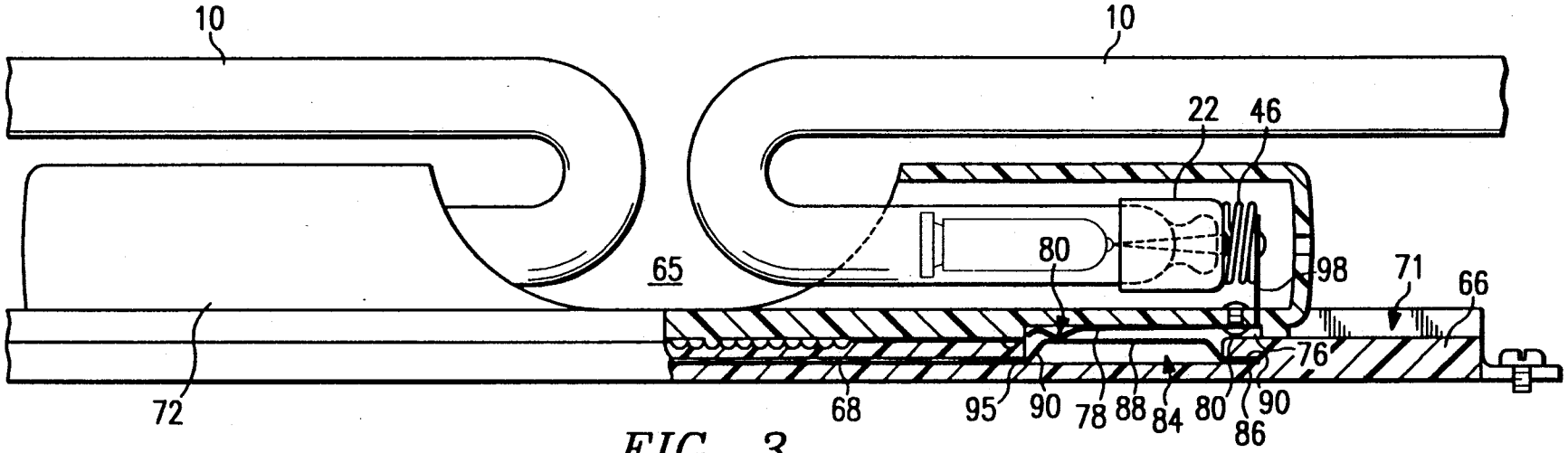
FIG. 3 is an elevation view of an alternate embodiment of the end-to-end connector assembly.
Figure 4:
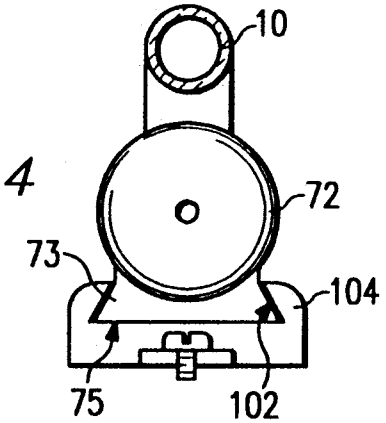
FIG. 4 is an end view of one of the electrode housings of the connector assembly of FIG. 3.

Referring now to FIGS. 3–4, elevational and end views are shown of an alternate embodiment of the end-to-end connector assembly of the present invention. As in FIG. 1, an electrical connection is effected between the caps 22 of the endwise supported neon tubes 10 through an end-to-end connector designated generally by the reference numeral 65. Connector assembly 65 includes a support base 66. A jumper connector 68 is embedded in or underlies the support base 66.

The connector assembly 65 includes the first and second electrode housings 72 supported on the support base 66 in opposed relationship. Referring briefly to the end view of FIG. 4, each housing 72 includes a base 73 that is engaged in a mating groove 75 extending longitudinally and along the top surface 71 of the base 66. Each housing 72 is thus slidably mounted in the support base 66 and is adapted to reciprocate between the first closed position and the second open position.

Each electrode housing 72 is formed on insulating material as previously described. In this embodiment, the housing base 73 includes a cutout portion 76. A spring-biased contact 78 is retained in the cutout portion 76 of the housing base 73 by screw 80. The spring-biased contactor includes a protrusion 82 adjacent to its distal end. The connector assembly 65 further includes a contactor platform 84 which includes a first or "edge" portion 86 and a second or "elevated? portion 88. The first portion 86 of the contactor platform 84 is retained in a slot 90 of the support base 66. The second portion 88 of the contactor platform underlies the spring-biased contactor 78 when the electrode housing is in the first position such that the protrusion 82 positively contacts the raised portion 88 of the contactor platform. As seen in FIG. 3, the distal end 90 of the contactor platform 84 is attached or soldered to a distal end 95 of the jumper. An electrical wire 98 is embedded in the electrode housing and interconnects the spring-biased contactor 78 to the spring-member 46.

As the electrode housing is reciprocated between the first and second positions, the protrusion 82 rides on the second portion 88 of the contactor platform and thus the electrical connection is maintained (provided the other housing is also in the first position). When the protrusion 82 clears the second portion 88 of the contact platform 84, the electrode housing is considered to be in the second position and the electrical connection is interrupted.

Figure 5:
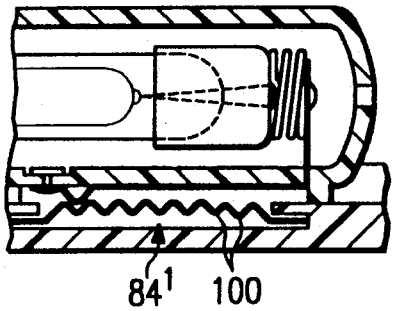
FIG. 5 is a detailed view of yet another embodiment of the invention wherein the end of the spring contactor is positively positioned in one of a plurality of spaced notches formed in a contactor platform.

Referring to FIG. 5, alternatively the contactor platform 84' includes a plurality of spaced notches 100, each of which is adapted to receive the protrusion 82 of the spring-based contactor. This arrangement provides a more positive contact and lock mechanism.

Although not shown in detail, it should be appreciated that the spring-biased contactor need not necessarily be supported under the electrode housing itself. Alternatively, the spring-biased contactor may be supported in a side wall of the electrical housing in which case the jumper would likewise be supported along the side, instead of underneath, the assembly. Alternatively, and with reference to FIG. 4 the spring-biased contactor could be supported along edge 102 of the electrode housing while the jumper (or the jumper/contactor platform arrangement of FIG. 3) is supported within retaining wall 104.

Figure 6:
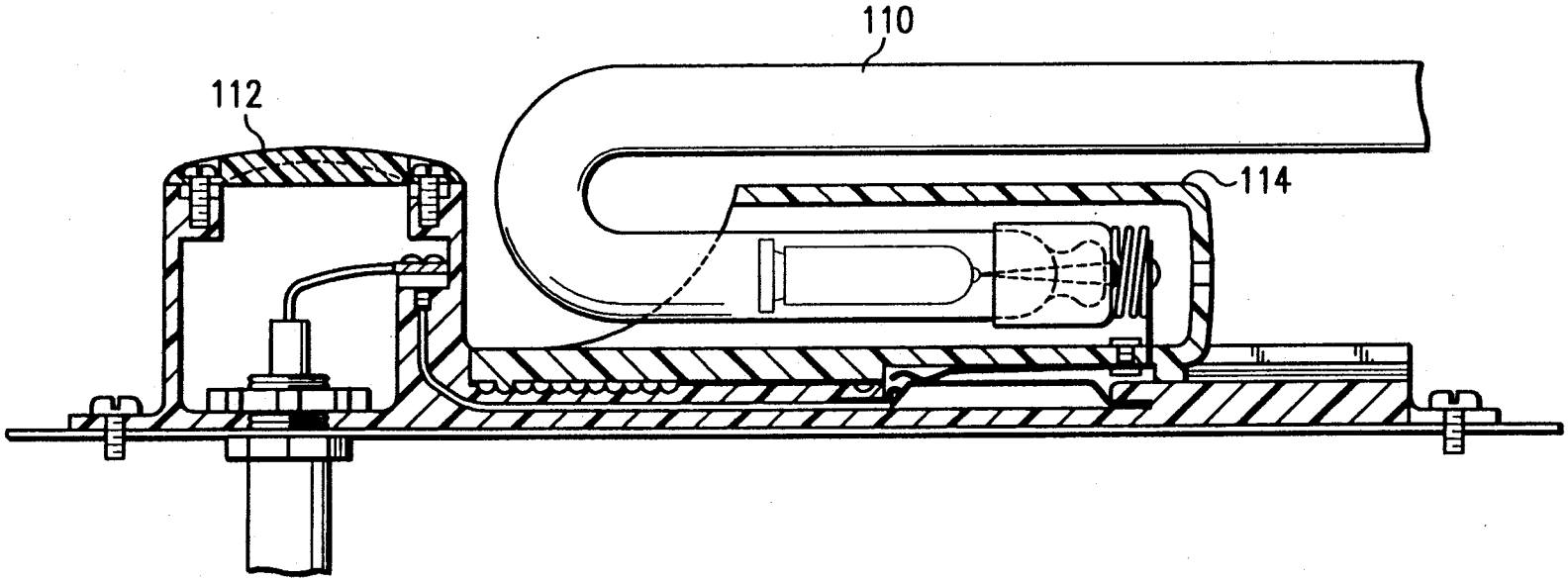
FIG. 6 is an elevation view of yet another alternate embodiment of the invention wherein a single electrode housing is connected to a terminating unit.

If desired, the jumper connector 28 may include a plurality of spaced notches 54 for receiving the contactor in one or more longitudinal positions. This structure enables the connector to be used with neon tubes of varying sizes. Moreover, although the connector is shown for use in an end-to-end installation, it should be appreciated that the principles of the invention are also applicable to an installation wherein an end of neon tube is supported for connection to an exciting transformer or terminating unit. For example, FIG. 6 is an elevation view of a neon tube 110 connected to a terminating unit 112. A single electrode housing 114 overlies the end of the tube 110 and is reciprocated as previously described. In such case only one electrode housing is required. Of course, the principles of the invention could also be used in other types of installations including florescent and incandescent lighting elements.

It should be appreciated by those skilled in the art that the specific embodiments disclosed above may be readily utilized as a basis for modifying or designing other structures for carrying out the same purposes of the present invention. It should also be realized by those skilled in the art that such equivalent constructions do not depart from the spirit and scope of the invention as set forth in the appended claims.

What is claimed is:

1. A connector assembly for a pair of neon tubes supported in an end-to-end manner, each of the tubes having a reversely bent end, comprising:

a support base formed of insulating material;

an electrical conducting strip supported in the support base; and first and second electrode housings supported in opposed relation, each of the electrode housing slidably mounted on the support base and including a spring-biased contactor connectable with the electrical conducting strip when the electrode housing is located in a first position and disengaged from contact with the electrical conducting strip when the electrode housing is located in a second position, wherein when both the first and second electrode housings are in their first positions an electrical connection between the neon tubes is completed and wherein when either the first or second electrode housing is reciprocated on the support base from the first position to the second position the spring-biased contactor in the reciprocated electrode housing is disengaged from contact with the electrical conducting strip to thereby interrupt the electrical connection between the neon tubes.

2. The connector assembly as described in claim 1 wherein each electrode housing comprises:

a base, a pair of sidewalls, a top and a closed outer end, each of the sidewalls including a sloped edge portion to define an inner end of the electrode housing, the inner end opening into a bore extending axially through the housing for receiving a reversely bent end of one of the neon tubes.

3. The connector assembly as described in claim 2 wherein the electrode housing is formed of an insulating material.

4. The connector assembly as described in claim 2 wherein the outer end of the housing includes a spring contact member for engaging an end cap of one of the neon tubes when the electrode housing is located in the first position.

5. The connector assembly as described in claim 4 further including a wire embedded in the electrode housing and connected between the spring contact member and the contactor.

6. The connector assembly as described in claim 1 further including fastener means for retaining each electrode housing in the first position.

7. The connector assembly as described in claim 1 wherein the support base includes a groove and each electrode housing includes an extension received in the groove to enable the electrode housing to slide on the support base.

8. A connector assembly for a neon tube having a reversely bent end, comprising:

a support base formed of insulating material and having a longitudinally-extending slot;

an electrical conducting strip supported in the support base underlying the slot; and an electrode housing including a spring biased contact element, the electrode housing being mounted on the support base for reciprocal movement between first and second predetermined positions;

wherein the spring-biased contact element is received in the slot to make contact with said conducting strip and provide an electrical connection to the neon tube when the electrode housing is in the first predetermined position and is disengaged from contact with said conducting strip and the slot when the electrode housing is in the second predetermined position thereby interrupt the electrical connection to the neon tube.

9. The connector assembly as described in claim 8 wherein the electrode housing comprises:

a base, a pair of sidewalls, a top and a closed outer end, each of the sidewalls including a sloped edge portion to define an inner end of the electrode housing, the inner end opening into a bore extending axially through the housing for receiving the reversely bent end of the neon tube.

10. The connector assembly as described in claim 9 wherein the electrode housing is formed of an insulating material.

11. The connector assembly as described in claim 9 wherein the outer end of the housing includes a spring contact member for engaging an end cap of the neon tube when the electrode housing is located in the predetermined first position.

12. The connector assembly as described in claim 11 further including a wire embedded in the electrode housing and connected between the spring contact member and the spring-biased contact element.

13. The connector assembly as described in claim 8 further including fastener means for retaining the electrode housing in the first position.

14. The connector assembly as described in claim 8 wherein the support base includes a groove and the electrode housing includes an extension received in the groove to enable the electrode housing to slide on the support base.

* * * * *